US006032940A

United States Patent [19]

Wolfe

[11] Patent Number: 6,032,940

[45] **Date of Patent: *Mar. 7, 2000**

[54] INDEXABLE JAW UNIVERSAL VISE

[75] Inventor: Ingo E. Wolfe, Brooklyn Park, Minn.

[73] Assignee: Kurt Manufacturing Company, Inc., Fridley, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/815,214

[22] Filed: Mar. 12, 1997

Related U.S. Application Data

[63] Continuation-in-part of application No. 08/772,355, Dec. 23, 1996, abandoned.

[51] Int. Cl.[7] ..... B25B 1/24

[52] U.S. Cl. ..... 269/279; 269/258; 269/43; 269/136

[58] Field of Search ..... 269/279, 271, 269/259, 258, 261, 247, 43, 46, 136, 154, 289

[56] References Cited

U.S. PATENT DOCUMENTS

| | | | |
|---|---|---|---|
| 1,279,011 | 9/1918 | Sanford . | |
| 1,375,236 | 4/1921 | Skinder . | |
| 2,499,124 | 2/1950 | Zipp et al. | 81/17 |
| 2,564,138 | 8/1951 | Walker . | |
| 2,570,857 | 10/1951 | Purpura | 269/279 |
| 2,744,430 | 5/1956 | McLaughlin et al. | 269/289 |
| 2,854,875 | 10/1958 | Patrick | 269/279 |
| 3,033,560 | 5/1962 | Eklund et al. | 269/240 |
| 3,342,057 | 9/1967 | Stone . | |
| 3,788,635 | 1/1974 | Nelson | 269/244 |
| 3,829,077 | 8/1974 | Strybel | 269/107 |
| 4,291,870 | 9/1981 | Warde | 269/279 |
| 4,383,682 | 5/1983 | Feinberg | 269/258 |
| 4,684,115 | 8/1987 | Krause | 269/136 |
| 4,928,937 | 5/1990 | Bernstein . | |
| 5,065,990 | 11/1991 | Durfee | 269/282 |
| 5,141,213 | 8/1992 | Chern . | |
| 5,163,662 | 11/1992 | Bernstein | 269/136 |
| 5,242,159 | 9/1993 | Bernstein | 269/43 |
| 5,442,844 | 8/1995 | Swann | 29/281.1 |
| 5,505,437 | 4/1996 | Durfee, Jr. | 269/43 |
| 5,649,694 | 7/1997 | Buck | 269/279 |

FOREIGN PATENT DOCUMENTS 171435 11/1921 United Kingdom .

*Primary Examiner*—David A. Scherbel
*Assistant Examiner*—Lee Wilson
*Attorney, Agent, or Firm*—Westman, Champlin & Kelly, P.A.

[57] ABSTRACT

A universal vise that has a movable and a fixed jaw that can be indexed at 90° increments to provide for four separate work clamping surfaces on each jaw. The vise includes a vise screw driving a nut that drives the movable jaw in each of four indexed positions of the movable jaw. The nut provides a down pressure load on the movable jaw with a very low profile. The indexable jaws permit the vise to be adapted to hold four different types of products or workpieces. The movable vise jaw is guided with keys that protrude above the plane of the guideway surfaces of the vise, so that the nut can have a shield rib that completely fills the space between the guideway surfaces to prevent chips from building up in a recess between the rails formed with present vise jaw nuts. The movable jaw and the fixed jaw do not protrude toward the base of the vise beyond the plane of the guideway surfaces on the vise rails. The movable jaw is held on the nut with a detent latch that permits changing of the jaw position when desired.

16 Claims, 13 Drawing Sheets

INDEXABLE JAW UNIVERSAL VISE

CROSS REFERENCE TO RELATED APPLICATION

This application is a continuation-in-part of my application Ser. No. 08/772,355, filed Dec. 23, 1996 is currently abandoned.

BACKGROUND OF THE INVENTION

The present invention relates to a universal vise that permits indexing the movable jaw to at least several positions and providing a jaw hold down force in each position as the movable jaw is clamped. The vise nut drive system permits both the movable and fixed jaws to be indexed at selected increments, as shown 90° increments, to provide different jaw surfaces for engaging a workpiece in each of the indexed positions.

Problems with chips falling on the vise screw are avoided by supporting the movable and fixed jaws above the plane of the vise guideway surfaces and forming the vise jaw nut to have a rib forming a shield between the guideways. The nut provides the guide keys for the movable jaw allowing the movable jaw position to be guided without projecting below the vise top surface.

In the prior art there are machine vises that include a cover over the vise screw and between the spaced apart guideways that are used for supporting the movable jaw. The cover closes the space above the vise screw to protect the screw from falling chip contamination. The opening overlying the vise screw is shielded or plugged so that chips do not fall onto the vise screw. Such a shield is shown in U.S. Pat. No. 5,442,844.

Because of the universality of machine vises, and the need for holding a plurality of irregularly shaped parts, many vise jaws are now adapted so that they can be "carved" to conform to the surface of the workpiece that they are to hold. The ability to carve the vise jaws is an important feature for universal use.

Prior art jaws which provide a hold down force as the movable jaw is clamped have a recess in the bottom of the movable jaw that receives a head portion of the nut with a load applying hook reacting against a part spherical seat washer. This caused the jaws to have either a very high profile, or in some instances, a relatively thin layer of metal over the recess, which restricts the depth of contouring that can be done for a part on the top of the movable jaw.

Prior vise jaws which provided a hold down force on the movable jaw also were made with a cast in loading surface along one side of the recess of the jaw forming the spherical seat. Thus only one side surface of such movable jaw can be used for holding a workpiece.

SUMMARY OF THE INVENTION

The present invention relates to a universal vise that provides a hold down force as the movable jaw clamps. The hold down force tends to force the movable jaw against the guideway surfaces of the vise body as well as holding a workpiece down on the vise support surfaces. The movable jaw and the fixed jaw are mounted onto vise body guideway surfaces, formed on the tops of spaced side rails which lie on a plane. A longitudinally extending vise screw and jaw nut are positioned between the rails. In the present invention, the movable jaw has a recess for receiving a head portion of the jaw nut, and a quick release detent holds the movable jaw in one of several (four as shown) separate indexable positions.

The nut engages a jaw loading member in each of the indexed positions in an identical manner, and the movable jaw thus is easily rotated to any one of the positions as desired for the particular workpiece to be held.

In a preferred embodiment the loading member is mounted so the jaw can manually be rotated to the four different indexed vise jaw positions with little, if any disassembly. Thus the movable jaw may be quickly moved to one of your working positions by indexing it relative to the vise jaw nut.

No part of the movable jaw protrudes below the plane of the jaw guideway surfaces of the vise. The nut has a rib or boss that fits between rails forming the guideways and has an upper surface that is very close to, or coincidental with, the plane of the guideway surfaces. The nut fits closely with the side rails to prevent chips from falling into a recess between the rails, where they can be trapped or can fall onto the vise screw. The ability to keep chips away from the screw and on a surface in a location where they fall out of the way and can easily be removed is important to high speed operations.

The movable jaw of the present invention is made so that the nut head portion that extends into the recess in the jaw can have a relatively low profile because the loading surface of the jaw engaged by the nut is maintained very close to the plane of the guideways. This permits a low profile movable jaw to be utilized while maintaining the spacing or thickness of material above the recess for the nut to be usable for sculpturing the jaw.

The nut hook engages the loading member very near the front clamping face of the movable jaw. This will reduce the bending of the movable jaw as much as 80% from the near center prior art clamping methods.

The reaction surface for the movable jaw nut also can be formed by a pin on the respective sides of the recess in the movable jaw. There can be four such pins located around the four sides of the recess. The jaw nut engages the pin and loads the movable jaw as the nut is tightened.

The fixed jaw of the present invention likewise does not protrude below the plane of the guideways, so the rib or boss of the nut that forms a chip shield can slide under the fixed jaw. The end of the nut thus can be lengthened so it will shield the screw even in a maximum open jaw position. The fixed jaw also is made so that it can be indexed into four separate positions and precisely positioned using guides fixed to the vise body. The clearance of the upper surface of the rib of the jaw nut is the same for both the movable jaw and the fixed jaw.

The fixed jaw is held in place on the vise body with capscrews that thread into the vise body from the top, and the apertures for the capscrews are counterbored to receive the capscrew head. The capscrew head is positioned in the range of ¾ of an inch below the top surface of the fixed jaw, which is of the same range of thickness of metal on the movable jaw overlying the recess for the jaw nut. This permits the fixed jaw to be sculptured or contoured in the same manner and to the same depth as the movable jaw.

Bolts or capscrews are used as needed for holding the fixed jaw in position in each of the indexable positions of the fixed jaw.

The movable jaw is retained on the nut in each working position with a spring loaded plunger or ball that can be released manually so that the movable jaw can readily be indexed into its new position and held in place. The movable jaw can be indexed even with objects positioned closely alongside. This permits rapid changing of the jaw faces, for different piece parts and the entire movable jaw can be removed and replaced with another. Each of the jaw surfaces used for holding a workpiece can thus be individually moved into position. Using the indexable jaws, and normal jaw plates, accessories such as contoured jaws, hardened jaws, and the like are easily accommodated. With the present device, the space between the jaws is protected from chips by the rib or boss on the jaw nut fitting between the guideway surfaces on the side rails of the vise.

In preferred forms a continuous or annular loading surface for the movable jaw nut is provided and the indexing position can be formed at any desired location around an upright central axis of the nut and movable jaw.

DETAILED DESCRIPTION OF THE PREFERRED EMBODIMENTS

Figure 1:
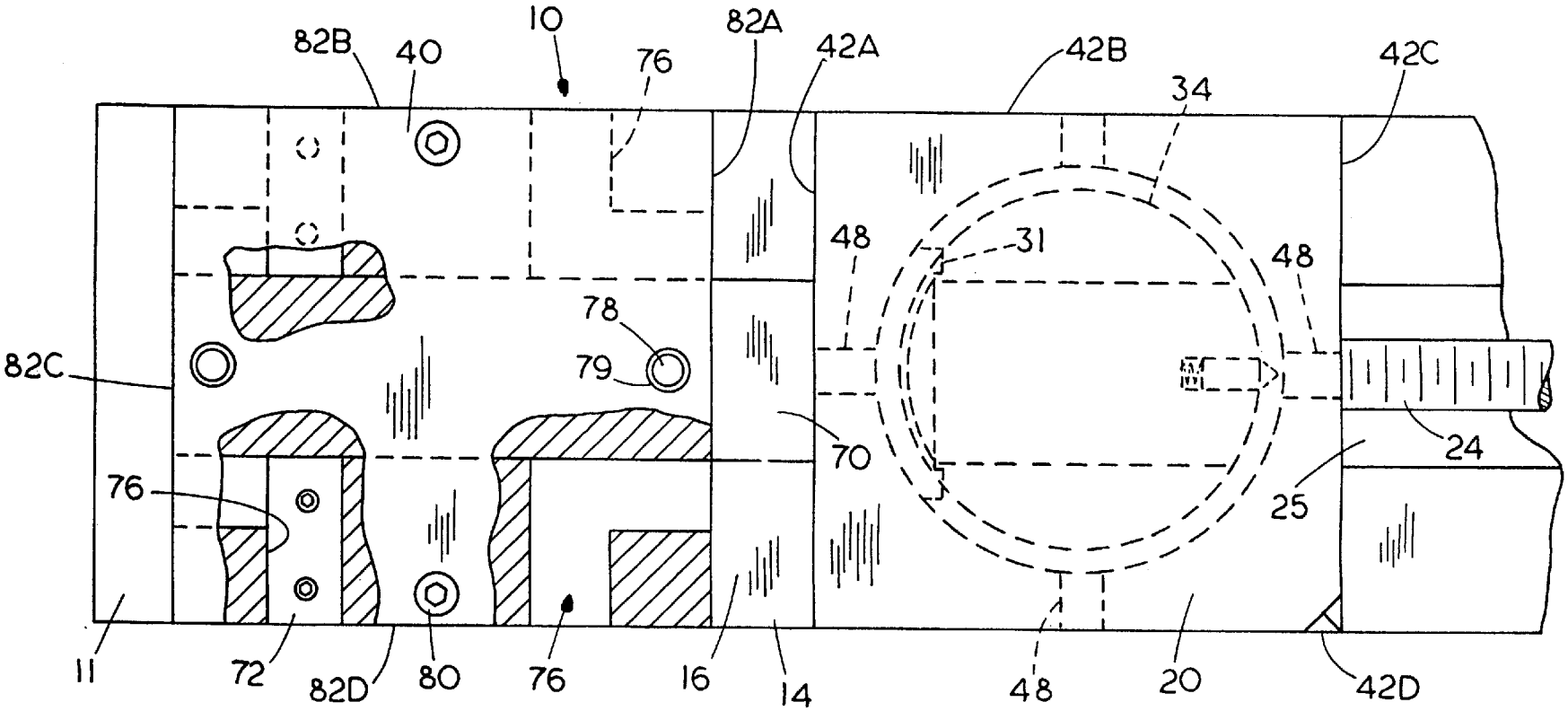
FIG. 1 is a top plan view of a universal vise having jaws and a vise screw nut made according to the present invention.

A machine vise of a first form of the invention indicated generally at 10 includes a vise body 11, which has a base plate 12 (see FIG. 3) and a pair of spaced upstanding side rails 14 that are supported on the base. The side rails 14 have upper surfaces 16 that are spaced apart and that lie on a common plane and form a guideway surface for a movable jaw 20 of the machine vise 10. The rails 14 have generally vertical guide surfaces 18 that define a space between the surfaces for guiding and supporting a vise nut 22, which is used for driving the movable jaw 20. The vise nut 22, as shown, is driven by a vise screw 24 that is suitably mounted in the vise body 11 and has a drive end (not shown) on which a screw crank or a suitable power drive device can be mounted for rotating the screw.

The vise screw 24 can be replaced with different types of screws from that shown, and the movable nut 22 can be driven by hydraulic actuators or power actuators of any desired kind.

The under surface 26 of the rails 14 in the interior slot or passageway shown at 25 through which the nut 22 travels are machined and guide the nut. The surfaces shown at 26 support and guide ears 28 on opposite sides of the nut 22. The lower side of the nut 22 has a lug 30, which is also guided in a shallow guideway 28A formed in the vise base 12. The lug indicated at 30 can be added to the bottom portion of the nut 22 for providing this guide, or can be cast integrally with the nut and machined when the nut 22 is machined.

The nut 22 has a head 32 that fits into a recess 34 formed on the bottom side of the movable jaw 20. The head 32 includes a hook 36 that is used for providing a force onto an angled loading surface 37 on a suitable drive member 31 on the movable jaw 20.

The edge of recess 34 has four indentations (as shown) formed on the bottom side for positioning the drive member 31 in four positions 90° apart, as will be explained. The recess has an annular shoulder 33 formed by an annular recessed groove 41 of larger diameter than the bottom opening into the recess 34. The drive or loading member 31 has a part circular flange 35 at its forward edge that seats on the shoulder 33. The loading surface 37 of drive or loading member 31 that is engaged by the hook 36 extends laterally across a chord of the recess 34. The loading member 31 is detented into position with a spring loaded plunger 38 fitting into one of the provided detent sockets 39 (four as shown). The loading member 31, and specifically the surface 37, mates with the under surface of the hook 36 so that as the nut 22 is moved longitudinally, toward a fixed jaw 40, the loading from the nut 22 causes the movable jaw 20 to move toward, or when the screw is rotated in opposite direction, away from, the fixed jaw 40.

Figure 5:
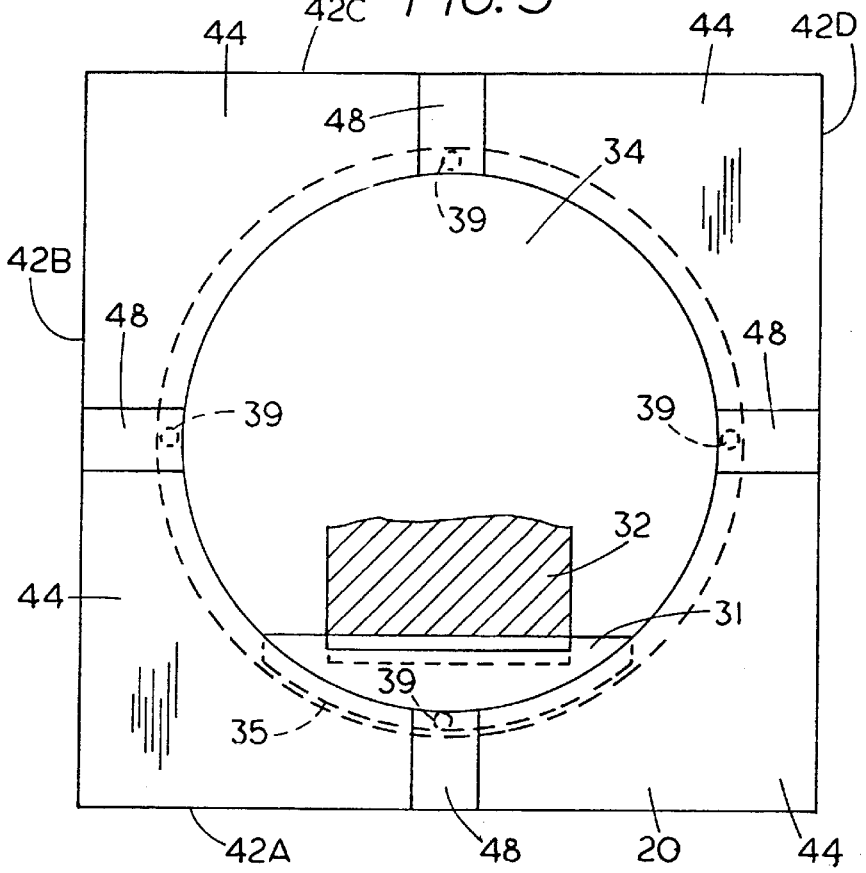
FIG. 5 is a bottom plan view of the movable jaw of FIG. 1.

It can be seen in FIGS. 1 and 5 that the recess 34 has indexed positions for the loading bar or member 31 along each of the clamping sides of the movable jaw 20, so as will be explained, the movable jaw 20 can be driven by the nut head 32 and hook 36 when the movable jaw is indexed so member 31 has been placed in one of the 90° intervals or other selected indexed positions. The clamping side surface of the movable jaw adjacent the loading bar or member 31 faces the fixed jaw 40. In other words the movable jaw 20 can have each of four separate sides facing the fixed jaw 40 and usable for clamping. These side surfaces shown at 42A, 42B, 42C, and 42D form four separate movable jaw faces that can be used for engaging a workpiece to clamp it against the fixed jaw 40.

The movable jaw 20 has a bottom surface with edge portions 44 that will slide upon and be guided by the guideway surfaces 16. The bottom surface edge portion 44 on each side of the movable jaw 20 rests on one of the surfaces 16. The movable jaw 20 is in one form held in place relative to the nut 22 with a pair of guide keys 46 formed on top of the nut 22. The keys 46 fit into recesses 48 formed in the bottom surface of the movable jaw 20. The recesses 48 are precisely machined at the desired indexing intervals (90° as shown) so that the jaw 20 will fit closely on the keys 46. In each of the indexed positions of the movable jaw 20 there are two recesses 48 aligned to receive the front and rear keys 46 on the nut 22. The keys 46 may be cast integrally with the nut 22, or they can be removably held in place so they can be removed for use in specialized applications, as will be explained.

The movable jaw 20 can be made to be indexed in a plurality of positions other than four by having location recesses 48 and detent recess 39 provided at the desired location. For example, 45° indexing is easily provided, and there is spacing enough so indexing the jaw every 20° is possible.

Figure 2:
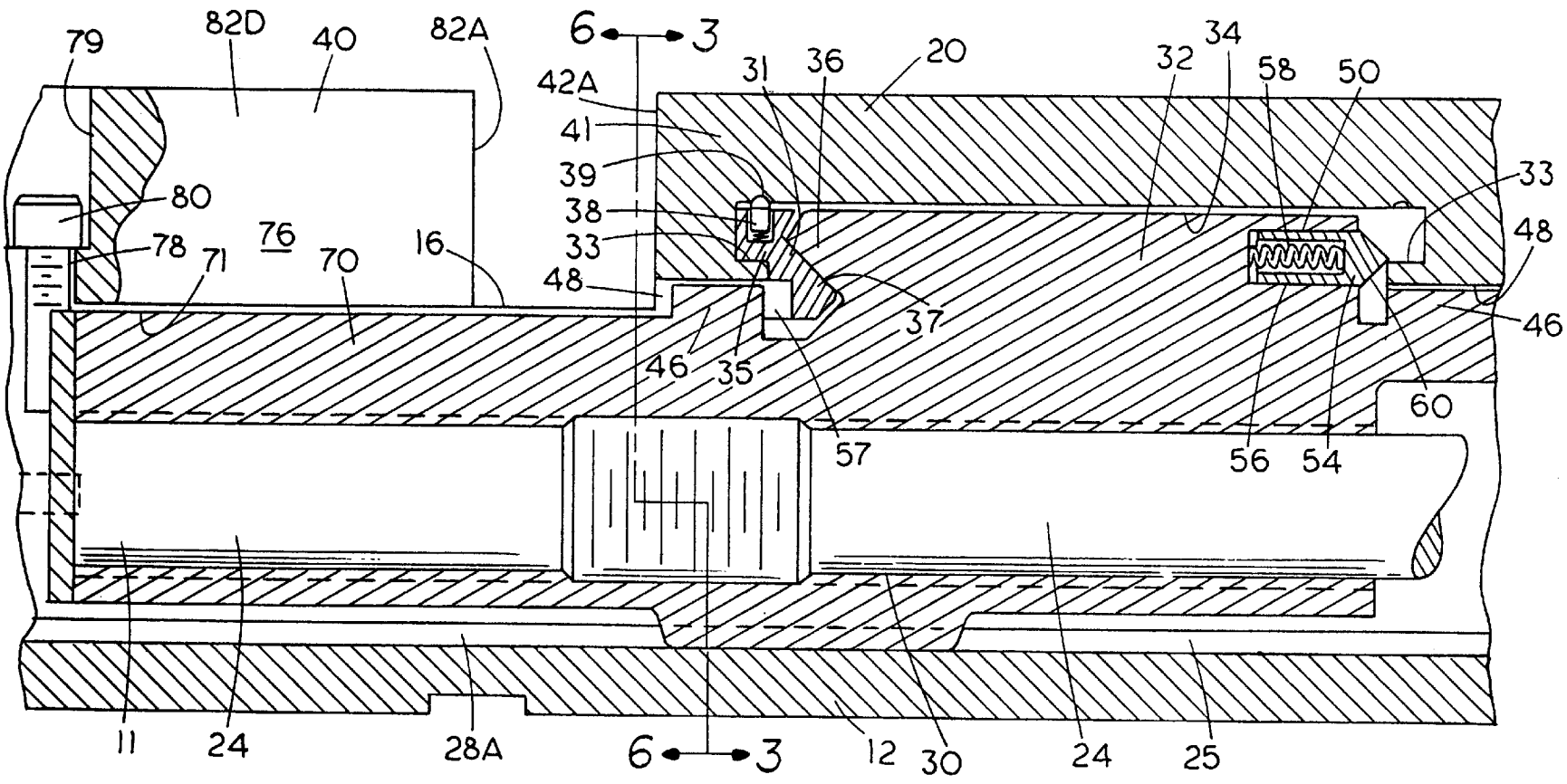
FIG. 2 is a fragmentary side view of the vise of FIG. 1 with parts in section and parts broken away.

As perhaps can be best seen in FIG. 2, the nut head 32 is held in place in the recess 34 with a spring loaded plunger assembly 50. A nut detent plunger 54 is slidably mounted in a short bore 56 in the back of the nut head 32. A spring 58 is held in a bore in the plunger 54 and reacts loads against the inner end of bore 56. The nut detent plunger 54 is thus urged rearwardly so the tapered rear end 60 of the detent plunger 54 engages an edge of the shoulder 33 formed by annular recess 41 of the cavity 34, and will hold the movable jaw 20 in place on the nut head 32.

In order to remove the movable jaw 20 from the nut, the jaw 20 is pushed in direction toward the fixed jaw 40. A recess 57 in the loading member 31 permits this movement. The end of the movable jaw can then be lifted past the hook 36 of head 32.

Because of the spring load provided for movement, the detent member 54 will retract and move out of the way when the rear end of the vise movable jaw 20 is moved forward and then lifted off the surface 16. The movable jaw 20 and loading member 31 can thus be removed from the nut head 32 if desired, and replaced with a different movable jaw.

Figure 3:
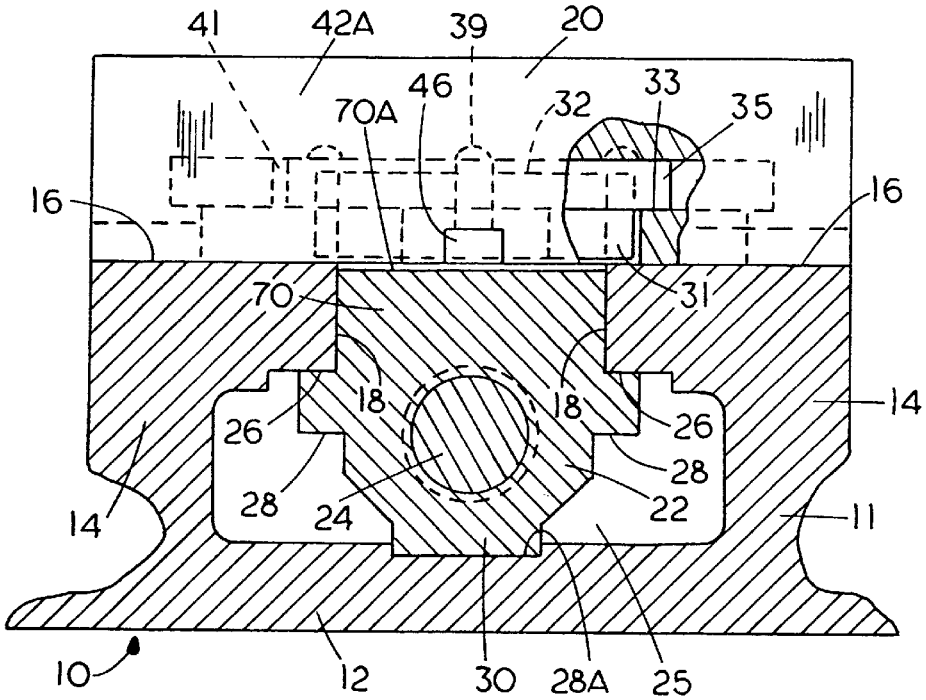
FIG. 3 is a sectional view taken generally along line 3—3 in FIG. 1.
Figure 4:
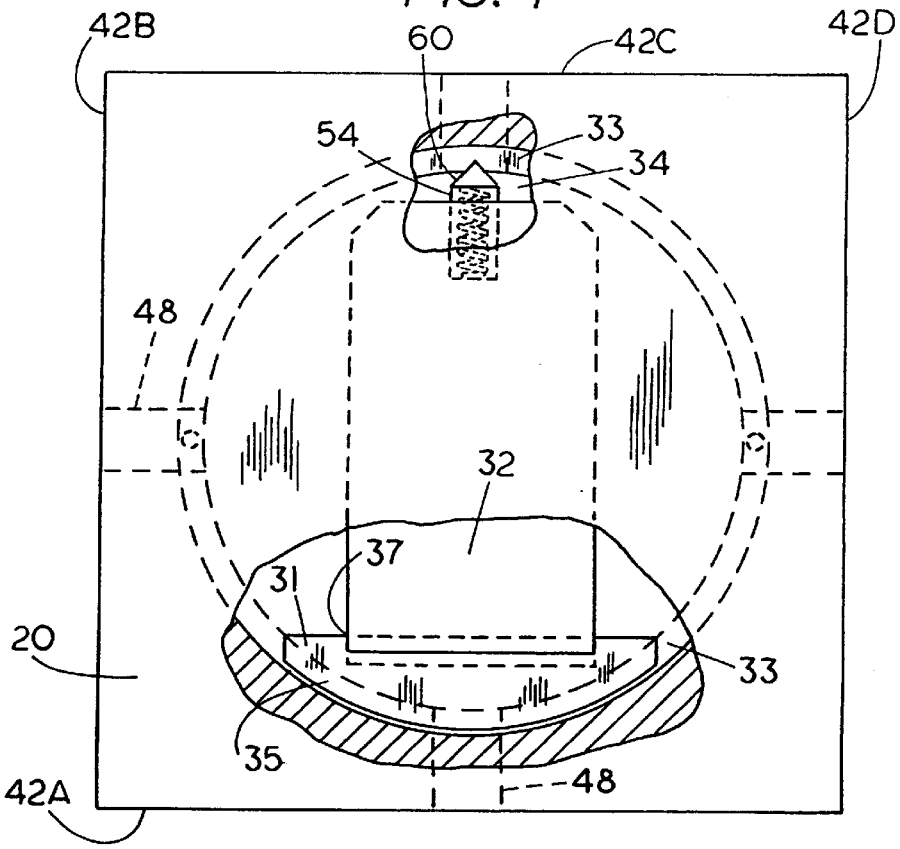
FIG. 4 is a fragmentary plan view of the movable jaw drive member for guiding and loading the movable jaw in its indexable positions.

The movable jaw 20 is moved by the nut 22, and is supported entirely above the plane of the horizontal guideway surfaces 16. The keys 46 on the nut 22 provide the working guides for the movable jaw 20 so there is no need to have guides on the movable jaw 20 extending below the plane of surfaces 16. The nut 22 is formed with a central rib portion 70 that extends up and closely fits between the vertical guideway surfaces 18, as can be seen in FIG. 3, to a level substantially equal to or very close to the plane of the horizontal guideway surfaces 16, to prevent chips from falling between the surfaces 18 onto the vise screw and causing problems. The chips fall on the upper surface 70A of rib 70 and can easily be blown out of the way.

The nut 22 is made of length so that the central rib portion 70 will extend between the movable jaw 20 and the fixed jaw 40 when the vise 10 is in its full open position, to protect the vise screw 24 from chips at all times.

The fixed jaw 40 is also maintained so that its bottom surface 71 does not protrude below the plane of the guideway surfaces 16, 16. This is accomplished by having locating or aligning guides or keys for the fixed jaw protruding above the plane of the guideway surfaces and having recesses formed in the bottom surface 71 of the fixed jaw 40 for receiving the guides.

As shown in FIG. 1, a first fixed jaw guide bar or key 72 is mounted onto the vise body near the end of one rail 14 and is positioned precisely by machining a recess in the rail surface 16 to receive key 72. A second fixed jaw key 72A is mounted on the other rail 14. The ends of the keys are spaced apart. The first and second keys 72 and 72A are aligned on the rails 14 and are held in place with suitable capscrews.

The fixed jaw 40 is provided with recesses 76 for receiving these keys 72. The recesses 76 are "L" shaped and there is one of the "L" shaped recesses 76 at each of the corners of the fixed jaw 40. The ends of the keys precisely locate the clamping surfaces 82A, 82B, 82C and 82D when indexed and received in the appropriate recess.

The fixed jaw 40 also has four or more countersunk bores 78 for receiving capscrews located at 90° to each other. The bores 78 have counterbores 79 that are of size to receive the heads of the capscrews 80, as shown at FIG. 2. The counterbores 79 are deep, to leave a desired amount of material above the heads of the capscrews 80, as will be explained.

At least two capscrews 80 are used for holding the fixed jaw 40, one threaded into each of the rails 14. The other two bores 80 that are shown are positioned above the slot between the rails 14 are left open. More capscrews can be used, if desired.

The fixed jaw 40 thus also has four clamping or jaw surfaces 82A, 82B, 82C and 82D. These jaw surfaces 82A–82D can be selectively positioned to be aligned with the movable jaw surface used for clamping. This permits both the movable jaw 20 and the fixed jaw 40 to have special contoured faces for particular parts. The movable jaw 20 can be moved quickly to each of its indexed positions, and the fixed jaw also can be indexed by removing the capscrews, indexing the fixed jaw and then reinserting the capscrews.

The "L" shaped recesses 76 leave a block of material at each of the corners of the fixed jaw 40. These blocks of material provide a corner support surface that rests on the surfaces 16 of the rails 14 to support the fixed jaw. The end surfaces of the recesses provide very precise, close tolerance locating surfaces to engage the ends of the close tolerance keys 72 and 72A.

The recess 34 in the movable jaw 20 is made so that there is a maximum amount of material above the recess when the unit is positioned to be shown at FIG. 1. Also, the counterbores 79 are of sufficient depth so that the material left above the head of the capscrews 80, permit the jaws to both be sculptured or machined the same amount on the top surfaces without interfering with either the capscrews 80 or the recess 34.

Figure 2A:
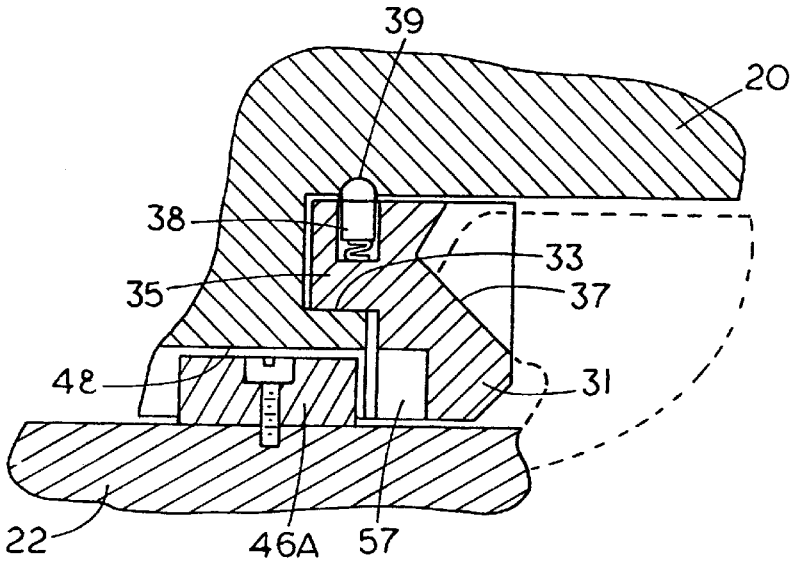
FIG. 2A is an enlarged cross sectional view of a loading member and vise nut hook shown in FIG. 2.
Figure 2B:
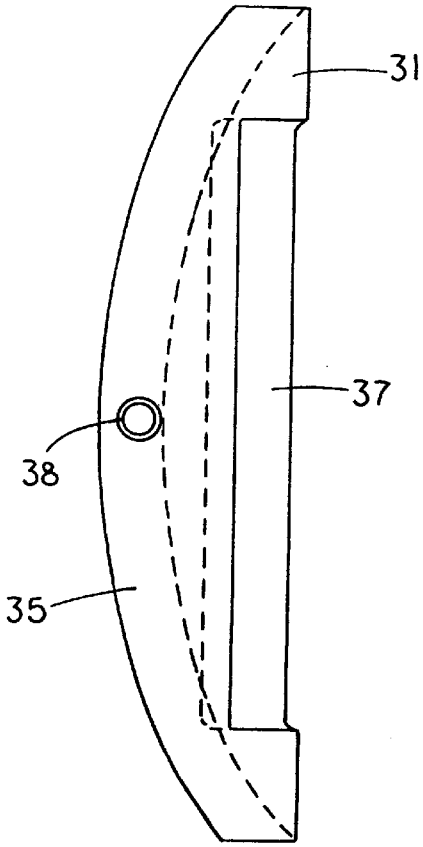
FIG. 2B is a plan view of the loading member of FIG. 2A.

The keys 46 as mentioned, may be separate keys that are held on the nut with capscrews. The front key 46A is shown separate in FIG. 2A. The removable keys are also shown in the second form of the invention. Key 46A in FIG. 28 is held in place with capscrews and the rear key also may be removably held with one or more sets screws. When the keys 46A are removed, the movable jaw can be positioned so the clamping face is at an angle relative to the face of the fixed jaw. The loading member 31, which has flange 35 that slides on annular shoulder 33, can be released from a detented position and then will self center as load is applied.

Figure 6:
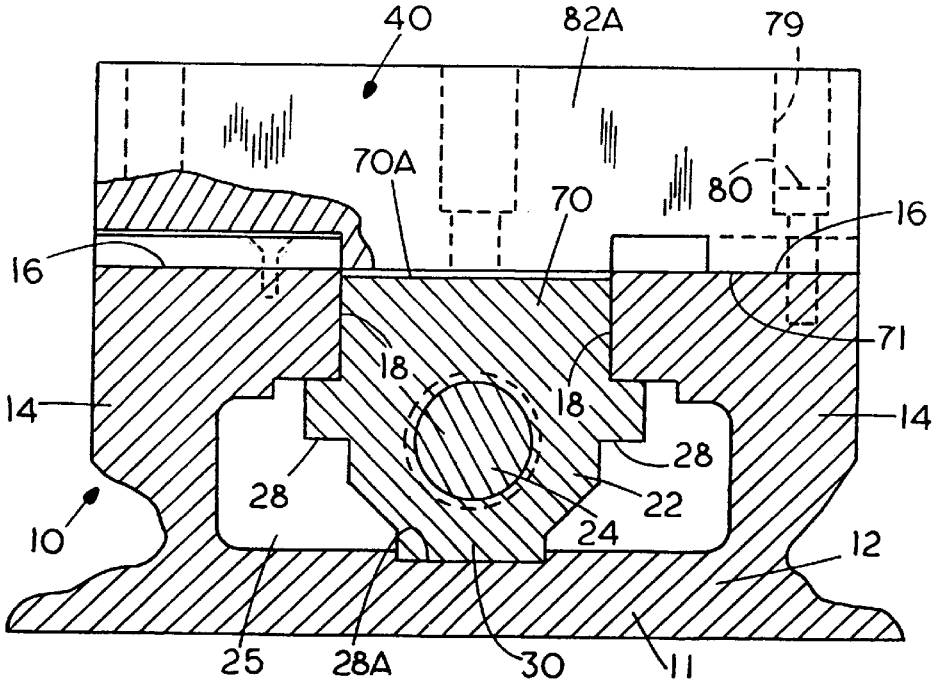
FIG. 6 is a sectional view taken on line 6-6 in FIG. 2 and showing the fixed jaw in position on the vise rails and the guideway surfaces.
Figure 6A:
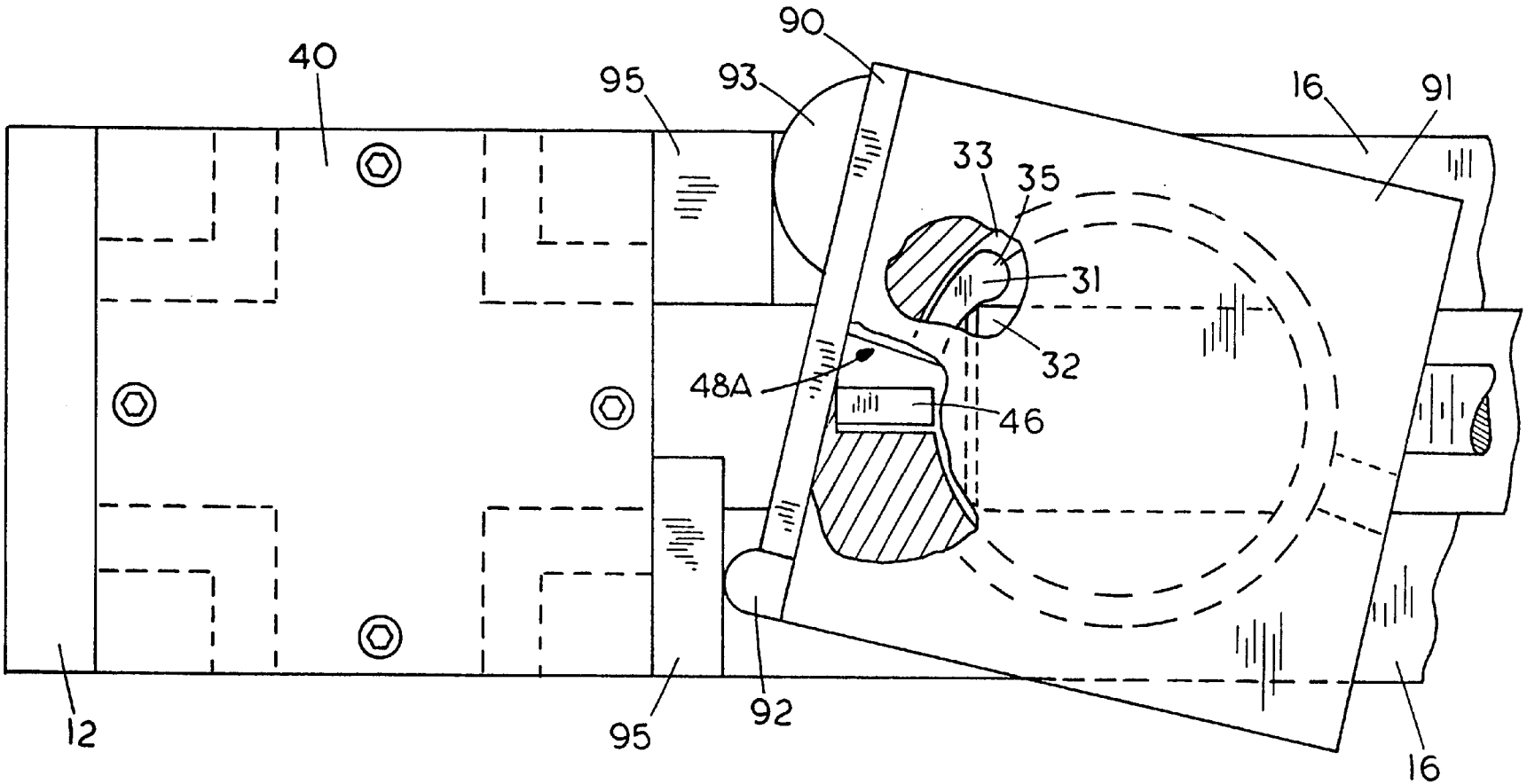
FIG. 6A is a top plan view of a universal vise showing the ability of the vise of FIG. 1 to have a clamp face of a movable vise jaw positioned at an angle.

The flange 35 on member 31, loaded by hook 36 will permit swiveling of the movable jaw for self centering on an angled clamping surface of a workpiece. Up to a 30° angle may be accommodated. Usually the angle is much less. This same ability of the loading member to self center on the shoulder 33 also will permit the movable jaw to be positioned at an angle, as shown in FIG. 6A, if the recess or key way for key 46 is formed in an arc so the keys 46 will slide for the desired angle. In FIG. 6A two arcuatly elongated key ways 48A are provided. The movable jaw is rotated at an exaggerated angle to illustrate that the movable jaw will rotate to clamp non parallel side workpieces, or two workpieces. A jaw plate 90 is mounted on movable jaw 91 and has two clamp lugs 92 and 93 thereon. The lugs can be used to clamp two workpieces 94 and 95 of different size, as shown. The loading member is acted on by the nut head 32 and provides a clamping force normal to the fixed jaw surface. The loading member flange 35 slides on shoulder 33 and lets the movable jaw self center as it clamps the workpieces 94 and 95.

The other parts of the vise in FIG. 6A are the same as in FIG. 1. Removal of the keys 46 permits swiveling the movable jaw as shown as well. Clamping two parts simultaneously increases the density of fixturing with the present vise.

In a second form of the movable jaw, shown in FIGS. 7–10, the machine vise 10 is made with the same vise body 11, which has a base plate 12 and a pair of upstanding side rails 14 that are supported on the base. The side rails 14 have the upper guide surfaces 16 on the opposite rails 14 to form guideway surfaces for a movable jaw 120 of the machine vise 10. The surfaces 76 lie on a common plane. The rails 14 are spaced apart as before and have generally vertical guide surfaces 18 that define a slot space between the surfaces for guiding and supporting a vise nut 122 which is used for driving the movable jaw 120. The vise nut 122, as shown, is driven by a vise screw 124 that is suitably mounted in the vise base 12, and has a drive end (not shown) on which a crank or other suitable power device can be mounted. The fixed jaw 40 is the same as in the first form of the invention and mounted in the same manner.

The vise screw 124 can be replaced with different types of screws from that shown, and the movable nut 122 can be driven by hydraulic actuators or power actuators of any desired kind.

The rails 14 form the interior passageway or slot 25 through which the nut 122 travels. The rails 14 have machined under surfaces 26. The surfaces 26 support and guide ears 128 on opposite sides of the nut 122. The lower edge of the nut 122 is also guided in a shallow guideway 28A formed on the vise base 12. A block indicated at 130 can be provided at the bottom portion of the nut 122 for providing the guide. The nut 122 has a head 132 that fits into a central recess 134 on the bottom side of the movable jaw 120. The head 132 includes a hook 136 that is used for providing a force onto a suitable loading member 138 on the movable jaw 120.

The recess 134 is a square chamber, and at each edge of the chamber there is a separate loading member comprising a pin 138 that is held in a bore 138A in the movable jaw. The pin 138 is partially in the recess 134 and has a surface exposed so it will mate with the under surface of the hook 136 at the respective edge of recess 134, so as the nut 122 is moved longitudinally toward the fixed jaw 40, the load from the nut 122 causes the movable jaw 120 to move toward the jaw 40. When the screw is rotated in opposite direction, the movable jaw moves away from the fixed jaw 40. The hook has an inclined load application surface to provide down pressure on the movable jaw.

Figure 10:
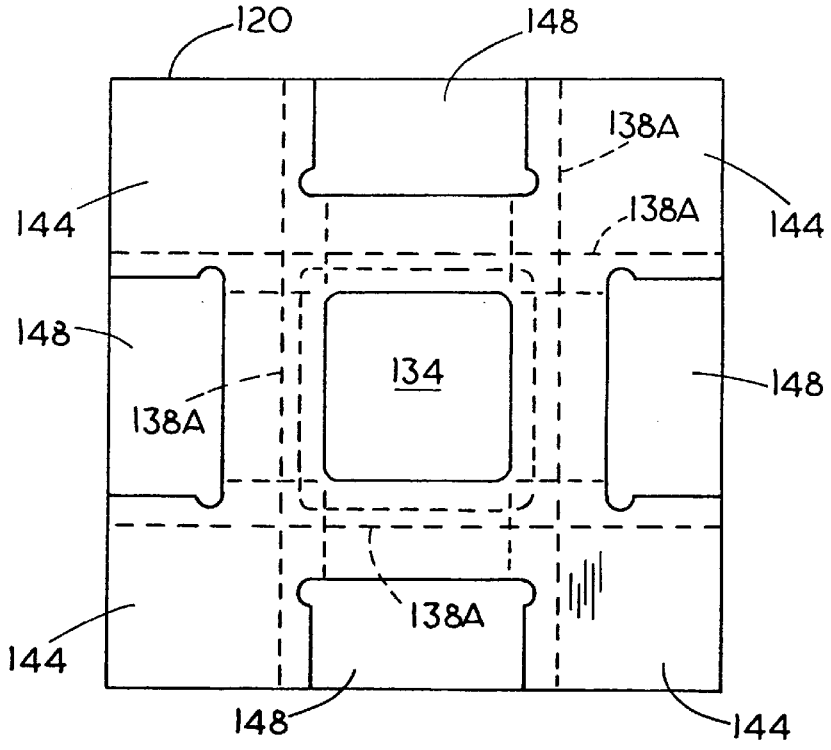
FIG. 10 is a bottom view of the movable jaw of FIG. 7.
Figure 9:
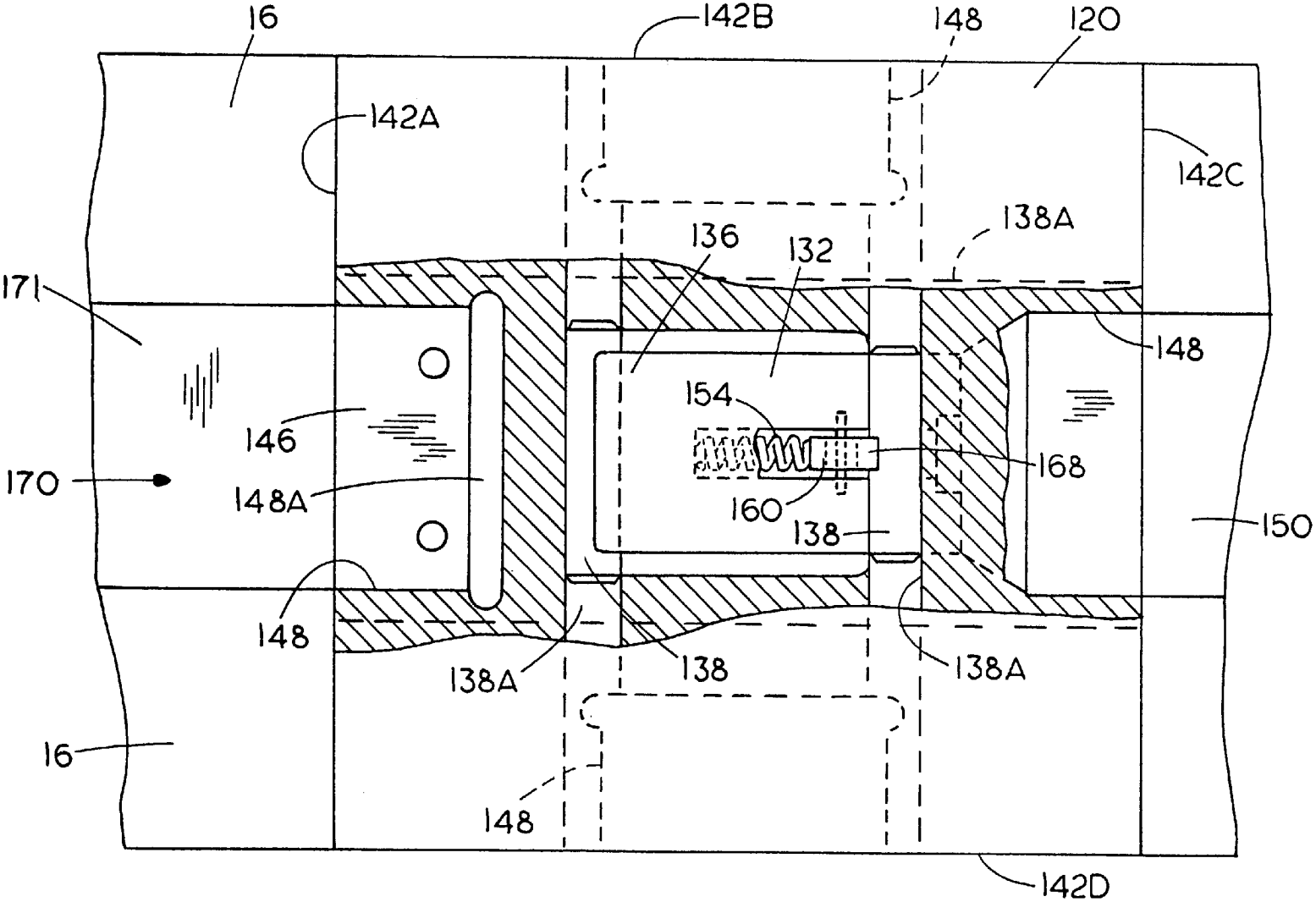
FIG. 9 is a top view of the movable jaw of FIG. 7 with parts broken away.

It can be seen in FIG. 10 that there are bores 138A and pins 138 adjacent and parallel to each of the edges of the recess 134 so the jaw 120 can be driven by the nut head 132 and hook 136 when the jaw has been indexed to any one of its four working position at 90° intervals. In other words the movable jaw 120 can have each of its four separate sides facing the fixed jaw 40. These side surfaces shown at 142A, 142B, 142C, and 142D form four separate movable jaw faces that can be used for engaging a piece part to clamp it against the fixed jaw 40. The loading members or pins 138 are fitted into the bores 138A in the movable jaw with center portions of the loading members 138 open to the chamber 134 for mating with the hook 136 of nut head member 132.

The movable jaw 120 has a bottom surface with edge portions 144 that will slide upon and be guided by the guideways 16. The side portions of bottom surface 144 on each side of the movable jaw 120 rest on one of the surfaces 16, and the movable jaw 120 is held in position relative to the nut 122, using a front guide block 146 that is mounted on the nut 122 and which fits between the facing rail surfaces 18, 18 very precisely. The block 146 also fits into the associated one of a plurality of locating recesses 148 formed in the bottom surface 144 of the movable jaw 120. The recesses 148 are precisely machined so that the jaw 120 will be precisely positioned. The nut 122 also has a rear guide block 150 that is mounted on the nut 122, in the form shown, or can be cast integrally. The guide block 158 fits into a recess 148C (FIG. 7) to stabilize the jaw 120 at both the front and rear and hold it precisely as it is guided toward the fixed jaw 40 to clamp a workpiece.

Block 150 can be held in place separately as shown with capscrews 152 on each side of the nut.

The movable jaw 120 is releasably held on head 132 with a spring loaded detent 157. A spring 154 is mounted in a short bore 156 in the back of the head 132. A recess 158 is formed at the rear of the head 132 and is of size to receive a pivoting detent member 160 that is pivotally mounted on a pin 162 in the head of the nut 132. The detent member 160 is urged by the spring 154 rearwardly a selected amount. A stop pin indicated at 164 can be used in a slot 166 of the detent member 160 to limit its travel. When the detent member 160 is in place on the movable jaw 120 and in the cavity 134, the rear end 168 of the detent member 160 will engage a surface of the cavity 134 or a loading member or pin 138, and hold the movable jaw 120 in place on the head 132.

Because of the spring load, the detent member 160 will pivot out of the way when the vise movable jaw 120 is moved forward, as permitted by a recess at the end of the guideway 148, as shown at 148A, upwardly with a reasonable force and then lifted upwardly.

Figure 7:
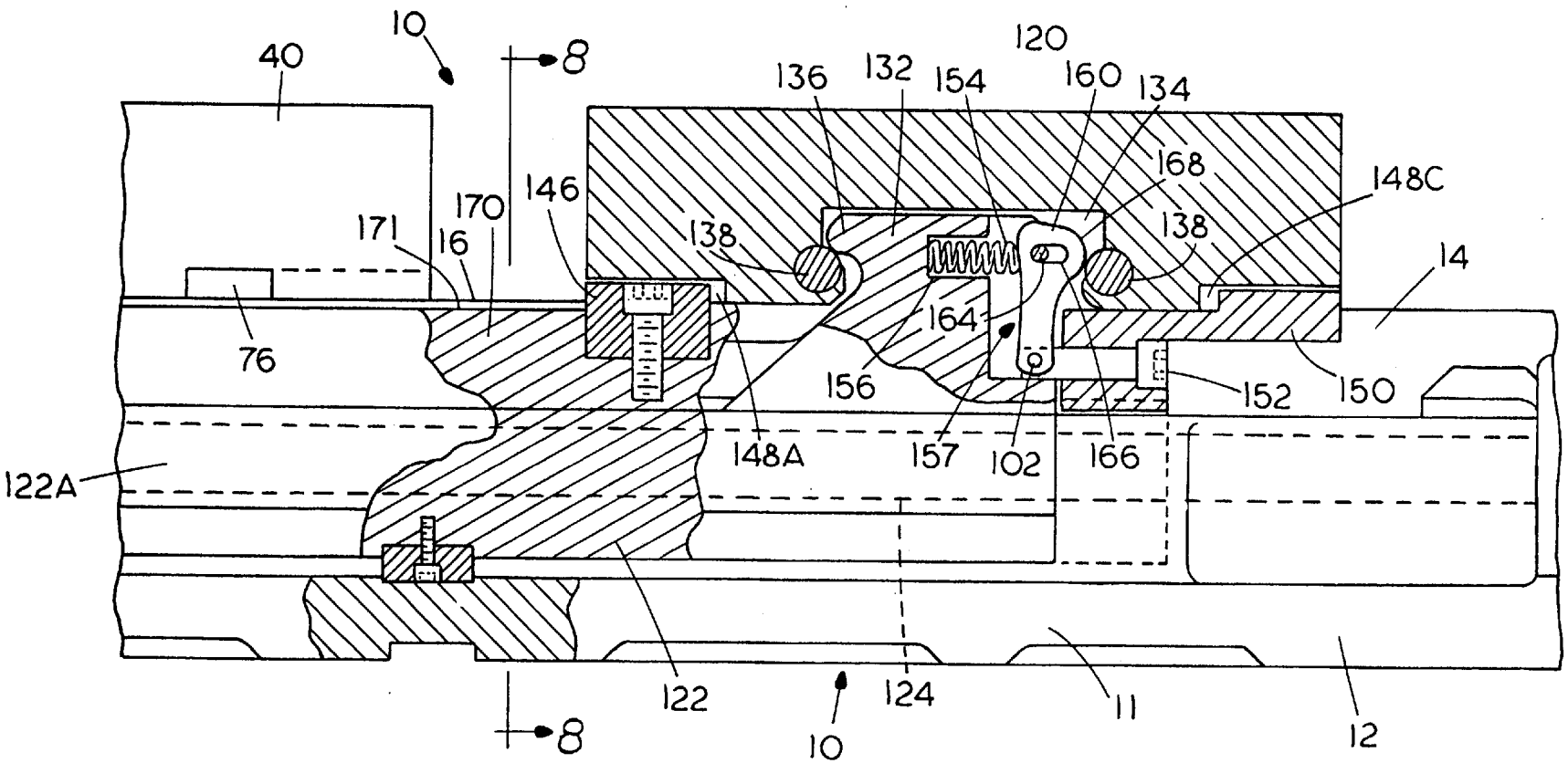
FIG. 7 is a side sectional view of a modified form of the vise nut and movable jaw of the present invention.
Figure 8:
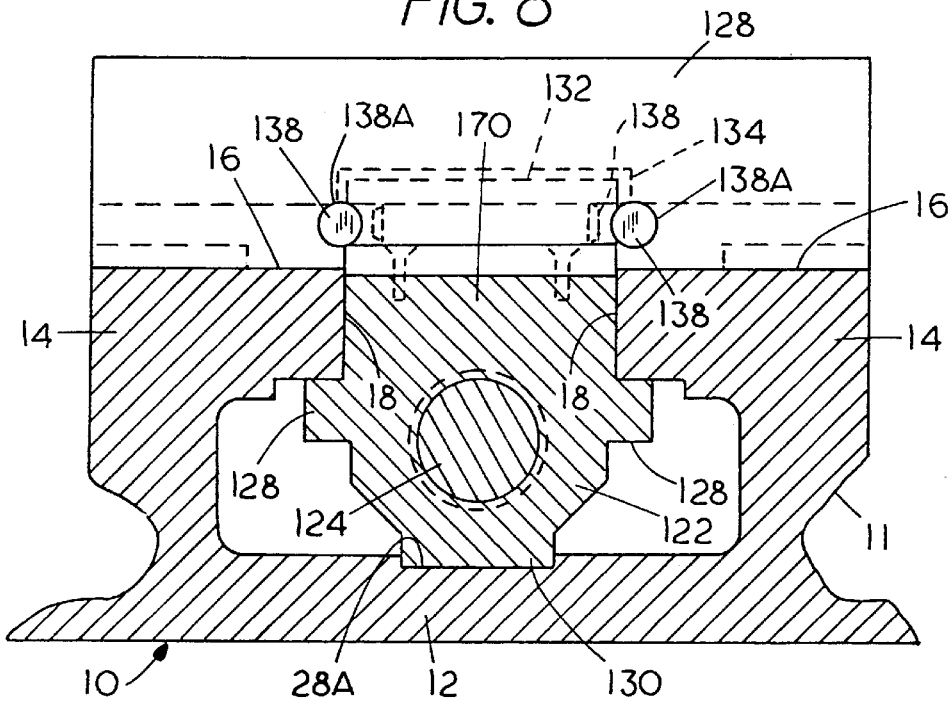
FIG. 8 is a fragmentary front sectional view thereof taken on line 8—8 in FIG. 7.

The movable jaw 120 thus is carried by the nut 122, and is supported on the plane of the guideway surfaces 16. This permits the nut 122 to be formed to include a central rib portion 170 that extends up and closely fits between the guideway surfaces 18, as can be seen in FIG. 7 so the upper surface 171 is at a level substantially equal to or very close to the plane of the surfaces 16. This rib 170 shields the screw 124 from chips falling down between the surfaces 18 of the rails and causing problems. The chips can easily be removed from surface 171.

The nut 122 is made so that the forwardly projecting portion 122A including the central rib portion 170 shown at will always extend between the movable jaw 120 and the fixed jaw 40 when the vise 10 is in its open position, to protect the vise screw 124 from chips at all times. The movable jaw 120 maintained above the plane of surfaces 16 so the movable jaw 120 does not interfere with the movement of the nut 122 and rib portion 120.

The movable jaw 120 has only a shallow recess 134 with maximum material above the recess for configuring the jaw.

In a further preferred embodiment shown in FIGS. 11–17 an arrangement is shown that provides for high hold down or clamping forces, as well as the ability to index the movable jaw easily to a large number of positions. In this form of the invention a machine vise indicated generally at 210 includes a vise body 211 which has a base plate 212, and, as in the first form of the invention, has a pair of upstanding side rails 214, 214 on opposite sides of the body. The side rails 214 have upper surfaces 216 which lie on a common plane and form guideway surfaces for a movable jaw 220 of the machine vise. The side rails 214 have generally vertical internal guide surfaces 218, 218 (see FIG. 13) that are spaced apart and are guides for a vise nut 222 made according to this embodiment of the present invention. The vise nut 222 is driven by a vise screw 224 in the form shown, but the movable vise can be driven with other types of screws or with power drives.

Figure 13:
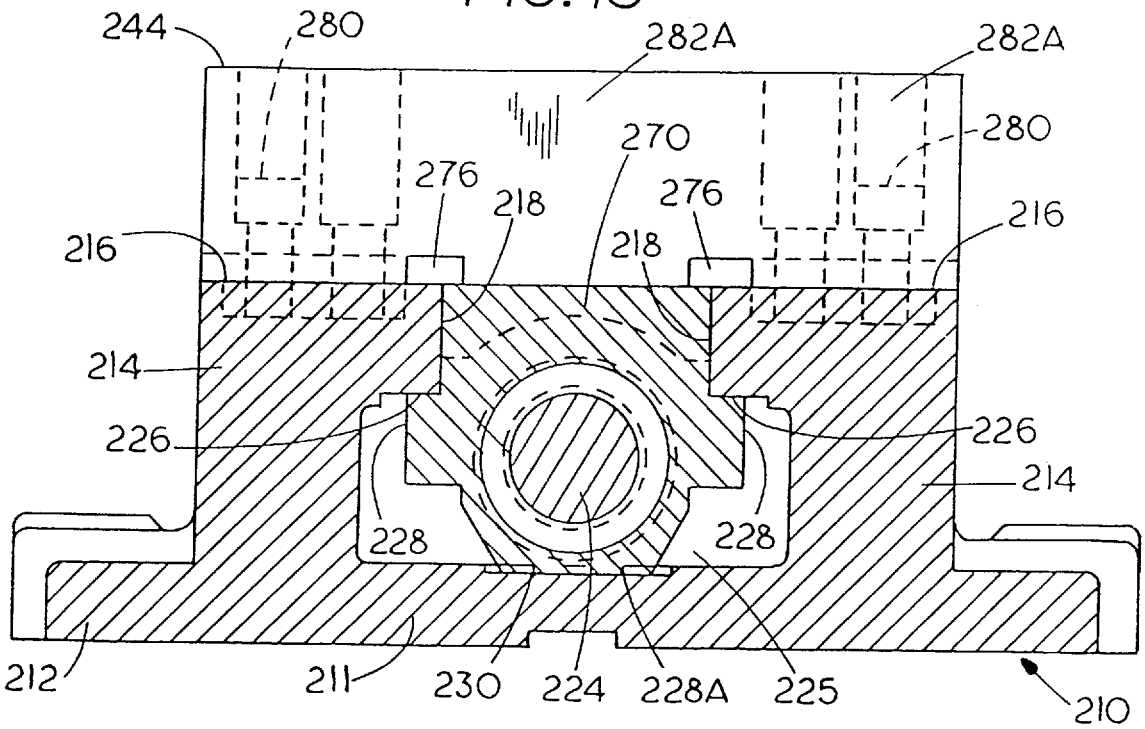
FIG. 13 is a cross sectional view taken on line 13—13 in FIG. 12.

The under surfaces of the rails 214, which are shown at 226 in FIG. 13 in the interior passageway 225 formed between the side rails 214, support the upper surface of guide ribs 228 that are on the sides of vise nut 222. The lower side of the vise nut 222 is tapered to form a guide end 230 that fits into a recess 228A in the bottom of the vise base 212 for guiding the nut 222.

The nut 222 has a head 232 that protrudes up into a recess 234 formed on the underside of the movable jaw 220. The movable jaw 220, as shown, has a substantial amount of material above the inner surface of the recess, so that the movable jaw 220 can be sculptured and made to conform to parts to be clamped, as desired.

Figure 11:
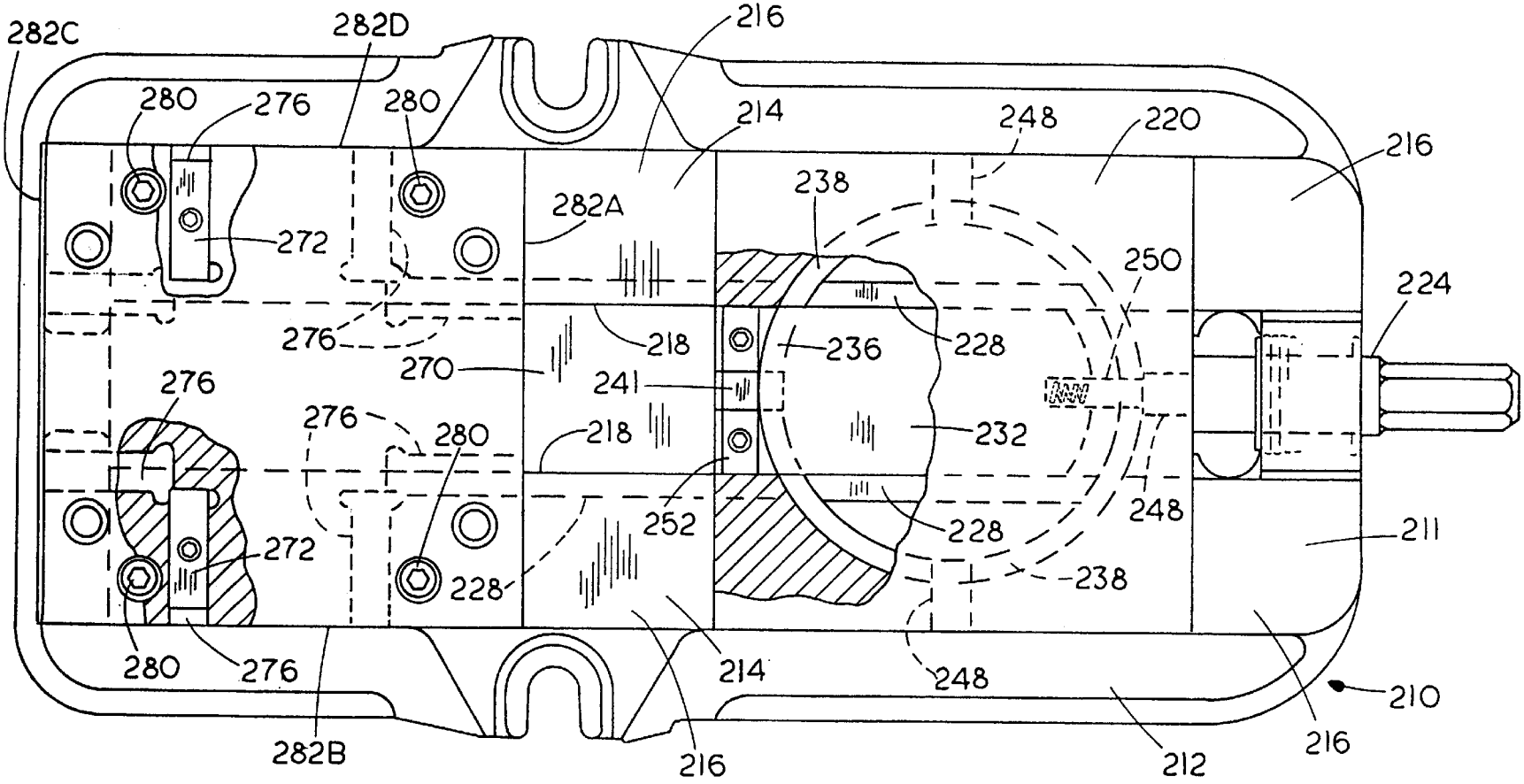
FIG. 11 is a top plan view of a universal vise having an indexable jaw mating according to another preferred embodiment of the present invention.
Figure 12:
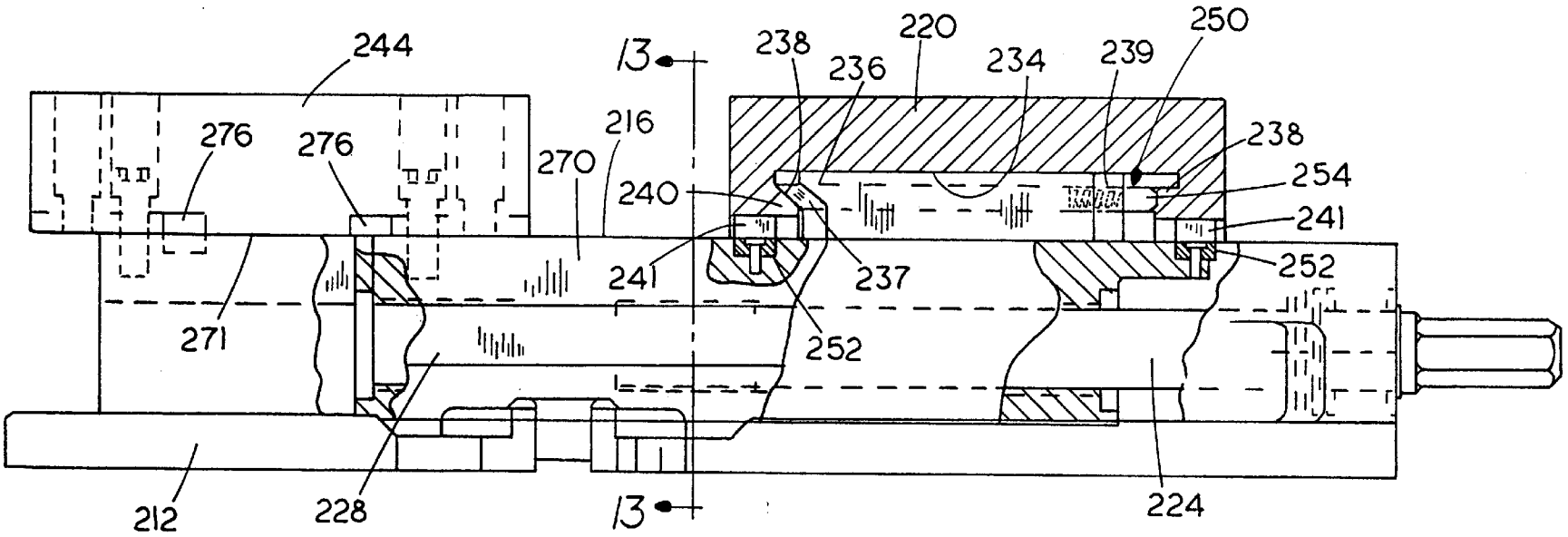
FIG. 12 is a side view of the vise FIG. 11 with parts in section and parts broken away.
Figure 14:
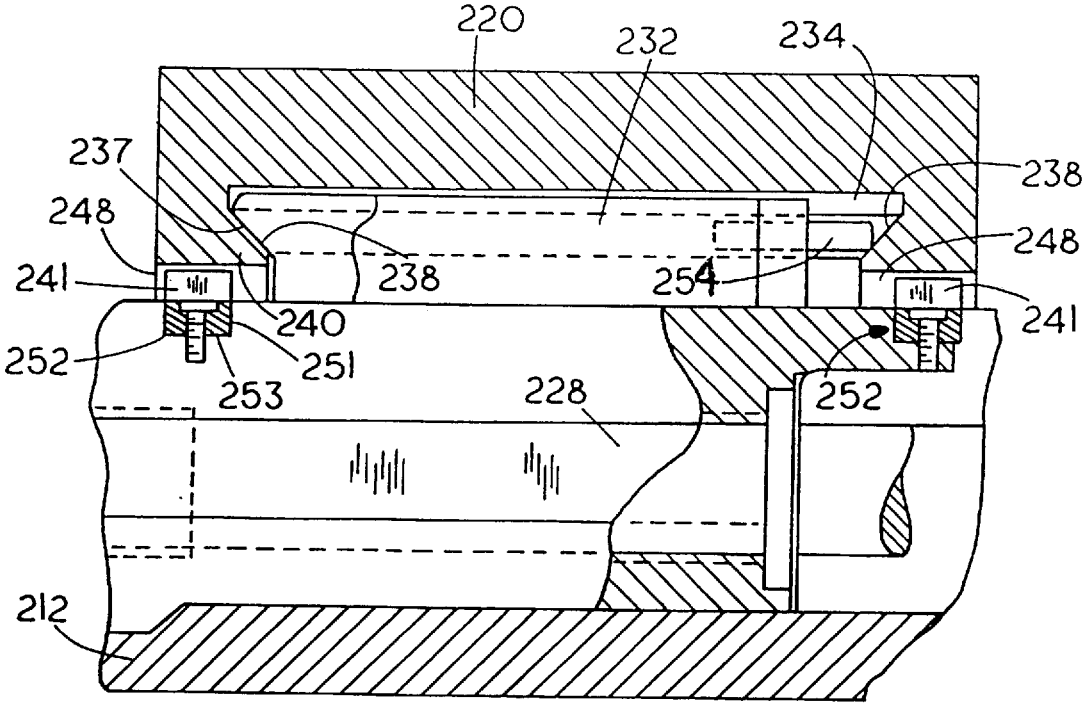
FIG. 14 is an enlarged sectional view of a movable jaw shown in FIG. 12 with parts broken away.
Figure 15:
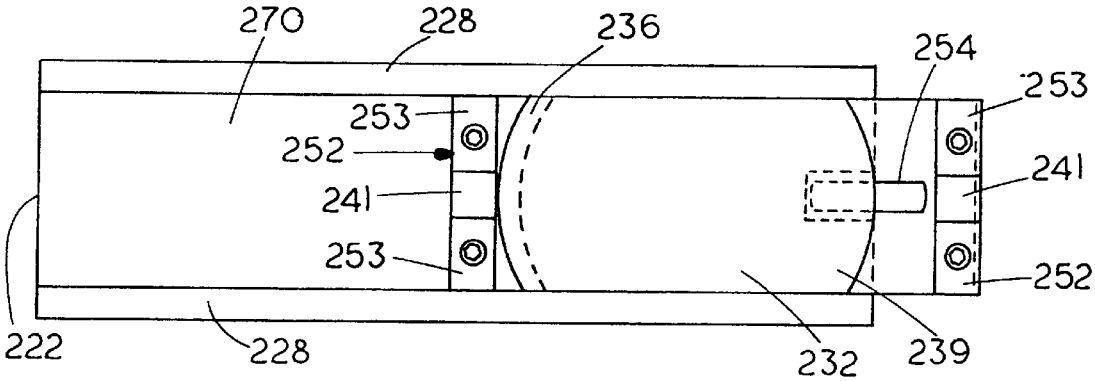
FIG. 15 is a top plan view of the nut used in embodiment of FIGS. 11–13.
Figure 16:
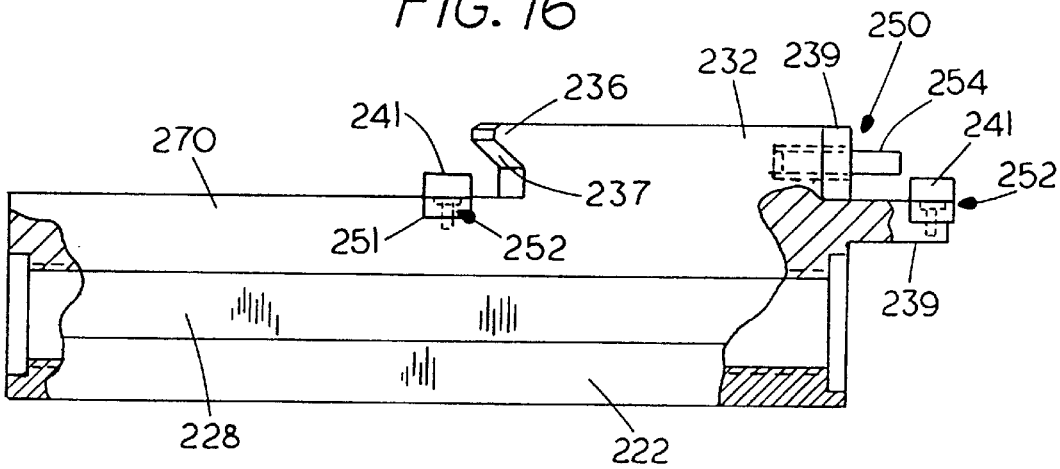
FIG. 16 is an enlarged side view of the vise nut shown in FIG. 14.
Figure 17:
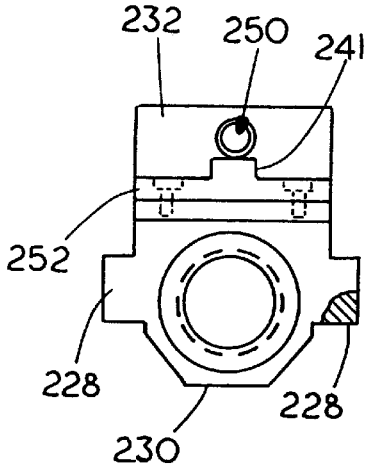
FIG. 17 is a rear end view of the nut of FIG. 16.

The vise nut head 232 has a forwardly projecting end portion 236 that forms a hook having a part conical, downwardly facing surface 237. The conical surface extends across the end of the head 232 facing toward a fixed jaw 244, which is the direction of clamping force for the vise. As can be seen in FIGS. 11, 14 and 16 the surface 237 is at a selected angle to provide loading onto a mating upwardly facing annular conical surface 238 formed on a flange 240 around the recess 234 in movable jaw 220. The conical surface 238 bounds the recess 234.

As shown, the nut head 232 also has a rear end portion 239 which does not have a conical surface and in which a suitable spring loaded detent plunger assembly 250 may be mounted. The plunger 254 is spring loaded to bear against the surface 238 at the rear side of the movable jaw. The plunger assembly 250 is made as shown in the first embodiment of the invention and will retract to permit the movable jaw to be removed.

As can be seen, the front or loading end of the nut head 232 is part circular, and extends for a suitable number of degrees to provide an adequate length of bearing surface between the surfaces 237 and 238 to properly load the movable jaw 220 against a workpiece that is to be clamped. The nut upper surface is provided with a cross groove 251 just ahead of the head 232, and a guide member 252 is mounted in the groove. The guide member 252 has side flanges 253 that are flush with the top surface of the nut and a center guide rib or key 241 extending in direction along the axis of the screw 224 which drives the nut. Rib 241 is made to fit into one of a plurality of recesses 248 formed on the underside of movable jaw 220 at suitable intervals around the central axis of the recess 234. The rear of the nut has a flange 249 that extends rearwardly from the main part of the nut. This flange forms a rear support for the movable jaw and has a cross groove for supporting a second guide member 252 with a rib or key 241 that fits into a recess 248 formed in the movable jaw.

As shown there are four recesses 248 for permitting the movable jaw to be indexed to four positions, but more recesses can be used. The movable jaw can easily indexed to almost an infinite number of positions because the conical surface 237 directly formed on the nut head 232 and the mating continuous conical surface 238 formed on flange 240 on the interior of the recess. The flange 240 forms a load receiving element for the movable jaw 220.

If desired, suitable detent members can be utilized as shown in the other forms of the invention, but in this form no detent members for indexing are illustrated. The movable jaw has jaw surfaces 242A–242D that engage a workpiece. The movable jaw positions are determined by the recesses 248 and ribs 241.

The movable jaw clamping surfaces 242A, 242B, 242C and 242D can be indexed to the respective positions facing a clamping surface of the fixed jaw 244. The movable jaw 220 has bottom surface portions along its edges that are supported on the guideway surfaces 216 of rails 214. The ribs or keys 241 can be cast with the nut 222 in this form of the invention if desired. The movable jaw can be indexed to a selected number of positions with the ribs or keys 241 positioned in selected recesses 248.

The movable jaw 220 and the fixed jaw 244 both are supported entirely above the plane 216A of the guideway surfaces 216. The jaw nut 222 has a rib portion 270 which extends between the guide surfaces 218 up to very close to or coincidental with the plane of the guideway surfaces 216. This serves the purpose of keeping chips out of the space between the surfaces 218, 218 of the rails 214 on the vise body.

The fixed jaw 244 is made so that its bottom surface 271 is flat and above the plane of the surfaces 216, so that the nut 222 can move underneath the fixed jaw as it clamps a piece part.

The fixed jaw 244 is provided with recesses 276 at each of its corners which are "L-shaped" (see FIG. 11) and are used for receiving very close fitting keys 272 that are on top of surface 216 and hold the fixed jaw 244 in position. The "L-shaped" recesses 276 are positioned so that the fixed jaw 244 can be indexed into four different positions with a clamping face aligning with the piece part holding face of the movable jaw 220. These fixed jaw faces are shown at 282A, 282B, 282C and 282D. The fixed jaw can be indexed to the four 90° positions by removing capscrews 280 that thread into the vise body in a suitable manner, and then indexing the fixed jaw to its desired position and reinserting the capscrews. The capscrews 280 can be mounted in any desired position for adequately and securely holding the fixed jaw on the vise body. The fixed jaw is provided with countersunk bores for receiving the capscrews. The counterbores for the capscrews of the fixed jaw are countersunk an amount at least equal to the minimum thickness of material of the movable jaw above the recess so both jaws can be sculptured or carved to hold a workpiece. Three-quarters of an inch of material is satisfactory.

The present form of the nut and the movable jaw provides for great utility and substantial hold down forces when the movable jaw is clamped under 5,000 to 8,000 lbs. of clamping pressure. The angle of the cone surface 237 is selected to provide an adequate hold down force component in direction toward the surfaces 216. The mating conical surface 238 is an internal continuous conical surface in the movable jaw. The recesses 248 are made to provide for indexing at desired locations. This form of the invention does not require a separate loading segment, but utilizes the conical surface of the movable jaw mating with a conical surface formed on the jaw nut. Otherwise it is much like the form of the invention shown in FIGS. 1–6A.

In the second form of the invention, the loading member from the jaw is more toward the center of the movable jaw. However, the preferred forms of FIGS. 1–6A and 11–16 show the loading members close to the clamping face of the movable jaw. Preferably the center line of force application between the nut and the loading member is in the first one-fourth of the distance between the clamping face of the movable jaw and the back side of the movable jaw for reducing bending of the jaw between the loading member and the clamping face. Higher jaw plates can be added to the jaw faces to clamp further away from the guide surface 16 without significant distortion of the movable jaw and clamping members.

Both forms of the invention provide vise jaws that can be indexed to at least four different positions to provide a plurality of clamping faces for use with different workpieces. Also the movable jaws can be removed from the nut and replaced easily for greater versatility.

Of course jaw plates can be placed on any of the clamping surfaces of either the fixed or movable jaws of the present invention. In the form shown, four jaw plates can be installed and then carved, or carved before installation and then mounted. Jaw plates such as shown in FIG. 6A also can be mounted and used. The movable jaw and nut provide a downward clamping load on the jaw because of the angle of force application from the nut head hook onto the loading member of the movable jaw.

The first and third forms of the invention allow many more indexed positions than the four positions shown. The shoulder or flange on the movable jaw and application of loads with conical surfaces, either on a loading member or on the movable jaw flange will seek a seat so the forces between nut hook 36 and surface 37 or surface 237 and 238 are distributed evenly to allow a higher clamping pressure without fracture of the loading member. The angular loading surface will seat with optimum contact, which is beneficial when workpieces are clamped off center from the center of the movable jaw width.

Although the present invention has been described with reference to preferred embodiments, workers skilled in the art will recognize that changes may be made in form and detail without departing from the spirit and scope of the invention.

What is claimed is:

1. A machine vise having a base member with a longitudinal axis, and a pair of rails defining an elongated slot that extends along the longitudinal axis, a first jaw and a second jaw mounted on said base and supported on upper surfaces of the rails, the upper surfaces being coplanar and at least said second jaw being movable in directions toward and away from the first jaw between a jaw closed position with the second jaw adjacent the first jaw and a jaw open position with the second jaw spaced from the first jaw by a distance;

a nut mounted in the slot for moving the second jaw upon actuation of the nut, said nut having a rib member that fits in the slot and extends to fill the slot to a level substantially equal to the upper surfaces of the rails, the rib being of length to extend the entire distance between the first and second jaws with the first and second jaws in the jaw open position, the first and second jaws being supported on the upper surfaces of the rails and positioned entirely above a plane lying on the upper surfaces of said rails, said nut having a head, said second law being coupled to said nut by a hook member on the head of said nut, which extends above the plane of the upper surfaces of the rails, said second jaw having a recess for receiving the head of said nut, a jaw loading member comprising a flange on the second jaw having an internal conical surface mating with a part conical surface moving with the hook member for carrying load from said hook member to said second jaw selectively at one of a plurality of separate positions of the second jaw.

2. A machine vise having a base member with a longitudinal axis, and a pair of rails defining an elongated slot that extends along the longitudinal axis, a first jaw and a second jaw mounted on said base and supported on upper surfaces of the rails, the upper surfaces being coplanar and said second jaw being movable in directions toward and away from the first jaw between a jaw closed position with the second jaw adjacent the first jaw and a jaw open position with the second jaw spaced from the first jaw by a distance, a nut mounted in the slot for moving the second jaw upon actuation of the nut, said nut having a rib member that fits in the slot and extends to fill the slot to a level substantially equal to the upper surfaces of the rails, the rib being of length to extend the entire distance between the first and second jaws with the first and second jaws in the jaw open position the first and second jaws being supported on the upper surfaces of the rails and positioned entirely above a plane lying on the upper surfaces of said rails, said first jaw being fixed to said vise base and spanning the slot, a pair of guide blocks mounted on said vise base, and extending upwardly from the surfaces of the rails to engage slots in said first jaw, said first jaw being secured with fasteners relative to the vise base.

3. An indexable movable jaw for a machine vise comprising a movable jaw having a plurality of outer side workpiece clamping surfaces bounding the movable jaw and the side clamping surfaces being spaced from a central axis, said movable jaw having top and bottom surfaces joining the side surfaces, a recess formed on the bottom surface and bounded by a circular flange enclosed within the outer side surfaces bounding the movable jaw, a load receiving element carried by the movable jaw and open to the recess and accessible from the bottom of the movable jaw for engagement by a drive element insertable into the recess from the bottom, the drive element being oriented to provide for a load on the load receiving element and selectively acting to move each of the side clamping surfaces toward a fixed jaw in separate indexable positions about the central axis, guides for guiding the movable jaw in each of the separate positions as the movable jaw is moved to clamp a workpiece, and a spring detent between the drive element and the movable jaw to urge the drive element to engage the load receiving element.

4. The jaw of claim 3, wherein said machine vise has support surface portions that lie on a plane, said movable jaw lying entirely on a side of said plane opposite a bottom of the vise.

5. The jaw of claim 3, wherein the drive element comprises a drive member for the movable jaw within the recess and the load receiving element including an annular surface surrounding the recess and loadable by the drive element to move the movable jaw toward a fixed jaw at selected annular positions of the movable jaw.

6. The jaw of claim 5, wherein the annular surface is conical and is engageable with a conical surface formed on the drive element to permit rotation of the movable jaw about the drive element.

7. The jaw of claim 5, wherein the movable jaw has a length from a side surface loaded by the drive element to an opposite side surface, the drive element loading the movable jaw at a location not substantially more than one-fourth of the length of the movable jaw from the side surface loaded.

8. The jaw of claim 3, wherein said recess is formed to leave a thickness of the range of three-fourths of an inch of material between the recess and the top surface of the jaw.

9. The jaw of claim 3, wherein there are four separate load receiving elements, each comprising a pin mounted in a separate bore extending parallel to each of the side surfaces, the bores intersecting a portion of the recess.

10. The jaw of claim 3, wherein the movable jaw has a bottom surface for guiding movement on a vise, a recess in the bottom surface, the recess having an annular groove on an inner end to form an annular shoulder comprising a part of the load receiving element and facing toward the top surface, and the load receiving element further including a mating part annular flange supported on the annular shoulder and having a portion extending across a chord of the recess and accessible to be engaged by the drive element.

11. The jaw of claim 3, wherein the load receiving element has a loading surface for engagement by the drive element, the loading surface being at a non orthogonal angle relative to the bottom surface of the movable jaw.

12. A vise body and nut assembly comprising a base, a pair of rails extending longitudinally along said base and being spaced apart to form a slot, said rails having upper surfaces that lie on a common plane and form support surfaces for a vise jaw, a jaw nut positioned on said body and movable between said rails, a head portion on the nut projecting above the plane, a movable jaw having a recess to receive the head portion with the movable jaw resting on the upper surfaces, a hook member on one end of the head portion, and a load carrying member on the interior of the recess including at least a first part conical upwardly facing surface engaging a complimentary mating part conical surface on the hook member overlying the first part conical surface for transferring forces from the nut to the movable jaw in at least a plurality of annular position of the movable jaw, the part conical surfaces permitting rotation of the movable jaw with the part conical surfaces overlapping.

13. The assembly of claim 12, wherein the load carrying member comprises an annular flange having a substantially continuous conical surface portion around the recess and formed around a center axis, the hook member part conical surface mating with the substantially continuous conical surface portion.

14. The assembly of claim 12, wherein the vise body includes a fixed jaw mounted on the rails adjacent an end thereof, the fixed jaw having mounting members to permit indexing the fixed jaw to a plurality of positions, each with a different clamping surface facing the movable jaw, the mounting members including capscrews countersunk from a top surface of the fixed jaw by an amount at least equal to the distance from a top surface of the movable jaw to the recess in the movable jaw.

15. A machine vise having a base member with a longitudinal axis, and a pair of rails defining an elongated slot that extends along the longitudinal axis, a first jaw and a second jaw mounted on said base and supported on upper surfaces of the rails, the upper surfaces being coplanar and at least one of said jaws being movable in directions toward and away from the other jaw;

a nut mounted in the slot for moving the at least one jaw upon actuation of the nut, said nut having a rib member that fits in the slot and extends to fill the slot to a level substantially equal to the upper surfaces of the rails, and having guide surfaces guided along sides of said slot; and a key on the nut and protruding upwardly from the vise base beyond a plane lying on the upper surfaces of the rails, said second jaw being the at least one jaw and being a movable jaw coupled for driving movement to said nut and having a recess for receiving the key on said nut.

16. The vise of claim 15, wherein the at least one jaw is a movable and has a plurality of recesses for receiving the key on the nut at different locations angularly spaced from each other, the movable jaw and nut being coupleable for driving movement at each of said different locations.

* * * * *